US006953111B2

(12) United States Patent
Chi

(10) Patent No.: US 6,953,111 B2
(45) Date of Patent: Oct. 11, 2005

(54) PROTECTIVE STRUCTURE FOR A TRAVEL CASE

(75) Inventor: Jim J. Chi, Sherwood, OR (US)

(73) Assignee: Yoshida Sports, Inc., Portland, OR (US)

( * ) Notice: Subject to any disclaimer, the term of this patent is extended or adjusted under 35 U.S.C. 154(b) by 0 days.

(21) Appl. No.: 10/359,739

(22) Filed: Feb. 5, 2003

(65) Prior Publication Data

US 2003/0178274 A1 Sep. 25, 2003

Related U.S. Application Data

(60) Provisional application No. 60/366,595, filed on Mar. 22, 2002.

(51) Int. Cl.[7] ..... A45C 13/00

(52) U.S. Cl. ..... 190/125; 150/154; 150/159; 150/127; 150/129

(58) Field of Search ..... 150/154, 159, 150/127, 129; 2/2.5; 428/101, 911; 89/36.01; 190/125, 124

(56) References Cited

U.S. PATENT DOCUMENTS

| | | | | |
|---|---|---|---|---|
| 921,352 A | | 5/1909 | Blaker et al. | |
| 1,282,411 A | | 10/1918 | Golembiowski | |
| 2,394,332 A | * | 2/1946 | Salem | 150/117 |
| 2,428,972 A | * | 10/1947 | Jackler et al. | 150/130 |
| 2,435,784 A | * | 2/1948 | Hoffman | 150/130 |
| 2,502,221 A | * | 3/1950 | Kaplan | 150/130 X |
| 2,727,548 A | * | 12/1955 | Kasdan | 150/129 |
| 2,792,043 A | * | 5/1957 | McLean | 150/129 |
| 2,795,258 A | * | 6/1957 | Berry et al. | 190/106 |
| 4,303,184 A | * | 12/1981 | Kloth | 190/52 |
| 4,544,051 A | * | 10/1985 | Saltz | 190/124 |
| 4,648,136 A | | 3/1987 | Higuchi | |
| 4,660,223 A | | 4/1987 | Fritch | |
| 4,694,505 A | | 9/1987 | Flosi et al. | |
| 5,287,903 A | * | 2/1994 | Ambasz | 150/130 |
| 5,515,541 A | | 5/1996 | Sacks et al. | |
| 5,565,264 A | | 10/1996 | Howland | |
| 5,738,925 A | | 4/1998 | Chaput | |
| 5,839,623 A | | 11/1998 | Losenno et al. | |
| 5,881,395 A | | 3/1999 | Donzis | |
| 5,906,873 A | | 5/1999 | Kim | |
| 5,976,996 A | | 11/1999 | Howland | |
| 5,996,115 A | | 12/1999 | Mazelsky | |
| 6,035,438 A | | 3/2000 | Neal et al. | |
| 6,266,818 B1 | | 7/2001 | Howland et al. | |

* cited by examiner

*Primary Examiner*—Tri M. Mai
(74) *Attorney, Agent, or Firm*—Alleman Hall McCoy Russell & Tuttle LLP

(57) ABSTRACT

The present invention provides a flexible, protective structure adapted to conform to the shape of an object being protected by the structure. The structure may be formed into a flexible travel case adapted to conform to the shape of the contents of the bag while still providing the protection of a hard, inflexible travel case. The structure may include a plurality of substantially rigid plates positioned adjacent a flexible skin.

14 Claims, 3 Drawing Sheets

PROTECTIVE STRUCTURE FOR A TRAVEL CASE

CROSS-REFERENCE TO RELATED APPLICATIONS

This application claims priority to U.S. Provisional Patent Application Ser. No. 60/366,595, filed Mar. 22, 2002 and entitled "Protective Travel Case".

BACKGROUND OF THE INVENTION

Travelers typically have two options when it comes to luggage and carrying cases. The first option is a hard protective case, often made of plastic, metal, or some other rigid material that provides nearly total protection for the contents of the case. Unfortunately, these hard cases tend to be heavy, particularly when used to carry large items such as golf clubs or other sporting equipment. Furthermore, the sheer size of the hard case may make transportation difficult. For example, hard golf club cases are typically shaped so that they resemble a long, elongated box, making them heavy, difficult to maneuver, and often too big to transport in small or medium-sized vehicles. Moreover, most hard cases take up a significant amount of storage room when not in use.

The second option for travelers is a soft "case" or bag, typically made of a durable fabric such as canvas. While these soft cases are typically lightweight and flexible so they can be easily stored, they generally provide inadequate protection for their contents, making users leery of using such bags when transporting expensive items such as golf clubs via an airplane, mail, or other means where the case may be subjected to rough handling.

Thus there is a need for an impact resistant, flexible structure that can be incorporated into a travel case such that the travel case can provide the protection offered by a hard travel case while simultaneously providing the flexibility and ease of storage offered by a soft travel case.

SUMMARY OF THE PRESENT INVENTION

The present invention provides a pliant structure that features impact-resistance without sacrificing flexibility. In one aspect, the present invention provides a travel case employing the pliant structure to provide the protection of a hard or rigid travel case while further offering the light-weight flexibility afforded by soft, i.e. fabric, travel case.

DETAILED DESCRIPTION OF THE INVENTION

Generally, the invention provides a pliant structure including a plurality of panels positioned adjacent a flexible skin. Typically, the panels are rigid or semi-rigid and associated with the flexible skin such that each panel is able to move relative to the flexible skin and each other. Thus, the rigidity of the panels does not significantly hinder the flexibility of the skin. In other words, the panels are able to move as the skin is flexed, thus allowing the structure to conform to movements of the skin.

Typically, though not necessarily, the flexible skin may be formed of some type of durable fabric such as canvas, rip-stop nylon, and the like. The panels may be formed of any suitable material and may include one or more layers of the same or different material. For example, the panels may include one or more impact absorbent layers made of foam or some other impact-absorbent material and/or one or more rigid layers made of a rigid or semi-rigid material such as plastic or metal. Alternatively, the panels may be molded or otherwise formed from a single material adapted to provide the desired degree of rigidity and/or protection from impact.

Figure 1:
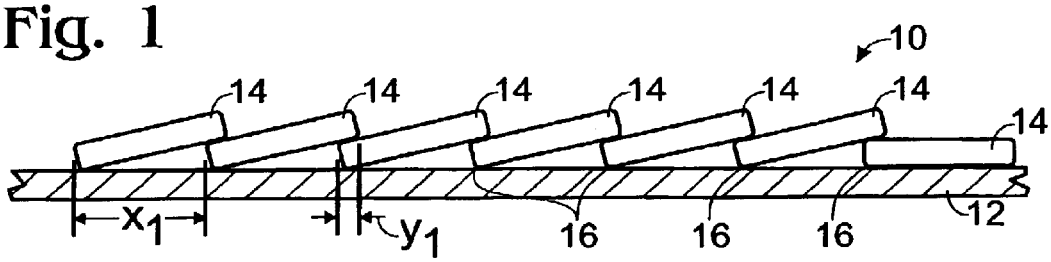
FIG. 1 is a side elevation of a pliant structure according to one embodiment of the present invention.

FIG. 1 depicts an exemplary embodiment of a pliant structure 10 according to the present invention. As shown, pliant structure 10 includes a flexible skin 12. Positioned adjacent flexible skin 12 is a plurality of semi-rigid panels 14. As shown, panels 14 may be overlapped in a manner similar to fish scales or an armadillo's protective plates. The panels may be secured to the flexible skin 12 by a hinge or pivot point 16. In the embodiment shown in FIG. 1, hinge 16 takes the form of a seam edge attaching one side of each panel to the skin 12. In this embodiment the hinge or pivot point allows each panel to swing and/or slide relative to each other and skin 12 when the skin is flexed. This relative movement allows the panels to protect all or nearly all of the surface area of skin 12, even as the skin is flexed and moved in different ways.

As will be appreciated, panels 14 may be secured to flexible skin 12 in any suitable fashion and the securing method may or may not create a hinge or pivot point. Moreover, in some cases one or more of the panels 14 may float, unsecured, between multiple layers of flexible skin, as discussed below.

Figure 2:
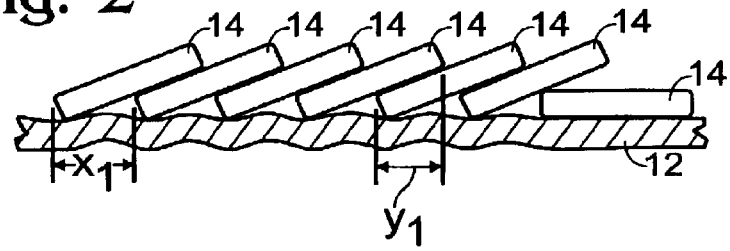
FIG. 2 depicts the pliant structure of FIG. 1 in a compressed configuration.

FIG. 2 depicts the pliant structure of FIG. 1 when skin 12 is scrunched or compressed. As shown the distance between the attached edges of the panels, labeled $x_1$ and $x_2$ in FIGS.

1 and 2, respectively, has been reduced, while the degree of overlap, labeled $y_1$ and $y_2$ in FIGS. 1 and 2, respectively, has been increased.

Figure 3:
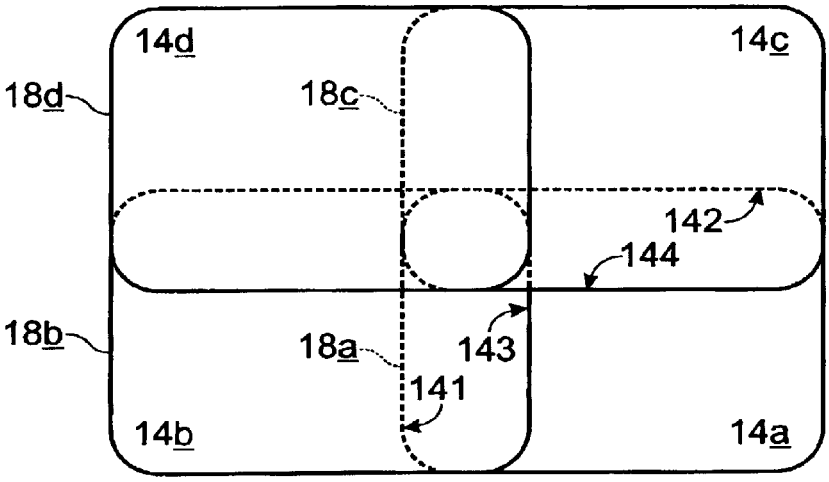
FIG. 3 depicts overlapping panels suitable for use with the present invention.

A plan view depicting exemplary overlapping panels is shown in FIG. 3. As shown, left panel edge 141 (shown in dashed lines) of panel 14*a* is overlapped by right panel edge 143 of panel 14*b*. Moreover, top panel edge 142 (shown in dashed lines) of panel 14*a* is overlapped by bottom panel edge 144 of panel 14*c*. This overlapping allows the panels to provide continuous protection over a predetermined surface area of the pliant structure. However, because the panels are attached only at the right edges 18, they can essentially float or glide over each other, allowing structure 10 to flex and/or compress without sacrificing the protection afforded by the impact resistant material in the panels.

As will be appreciated, alternative patterns of overlap may be used. For example, the present invention may include a plurality of panels having tapered edges and secured to a flexible skin along a single seam located at the center of the panel. Furthermore, each panel may be secured to the flexible skin at more than one point, seam, or edge.

Figure 4:
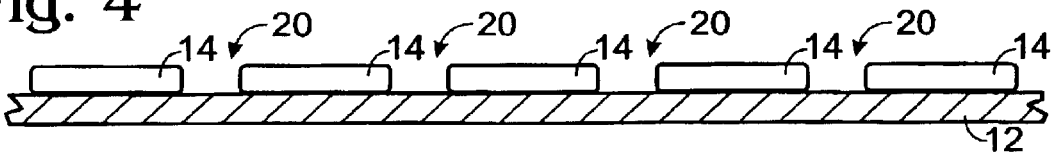
FIG. 4 is a side elevation of a pliant structure according to another embodiment of the present invention.

It may not be necessary for panels 14 to completely cover the entire surface area of skin 12 through the entire range of movement. For example, panels 14 may be situated such that gaps between panels may appear when skin 12 is moved in certain ways. Moreover, the panels need not overlap at all. For example, an alternative embodiment of structure 10 is shown in FIG. 4. In this embodiment, panels 14 are not overlapped, but instead are interspersed across skin 12. The gaps 20 between panels allow skin 12 some degree of flexibility and movement. Moreover, the interspersed panels may be attached along a single seam, as described above, to increase the degree of flexibility and movement.

It should be appreciated that the panels may be of a variety of different polygonal, curved, or other shapes, such as squares, rectangles, hexagons, ovals, circles, half circles, crescents, or non-uniform shapes. Moreover, more than one panel shape may be used in the same structure 10. For example, it may be desirable to use a first panel shape in a first portion of the structure and a second panel shape in a second portion of the structure. Alternatively, multiple panel shapes may be used in the same portion or general area to give the structure a desired shape or degree of flexibility. It should be further appreciated that the attachment points of each panel may likewise depend upon the shape of the panel and the desired shape of structure 10.

Figure 5:
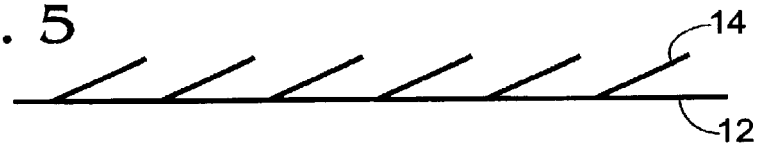
FIG. 5 is a simplified side-view of the structure of FIG. 1 in a taut conformation.
Figure 6:
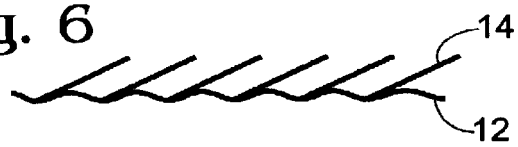
FIG. 6 is a simplified side-view of the structure of FIG. 1 in a compressed conformation.
Figure 7:
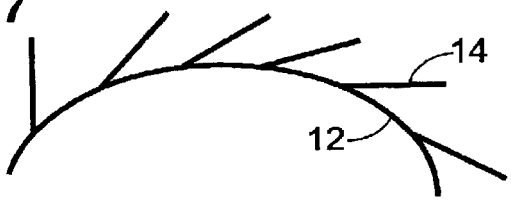
FIG. 7 is a simplified side-view of the structure of FIG. 1 in a concave conformation.
Figure 8:
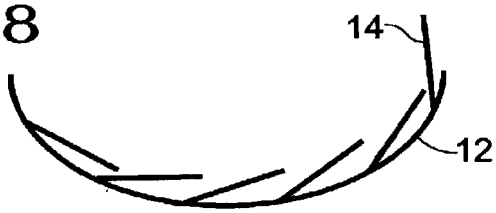
FIG. 8 is a simplified side-view of the structure of FIG. 1 in a convex conformation.

FIGS. 5–8 are simplified diagrams showing a side view of overlapped panels 14 adjusting to various conformational changes by skin 12. In FIG. 5, skin 12 is pulled taut and the panels 14 overlap to a certain degree. In FIG. 6, skin 12 is compressed. As shown, when skin 12 is compressed, the degree of overlap between adjacent panels is increased. In FIG. 7, skin 12 is flexed into a concave shape and the panels adjust accordingly. In FIG. 8, skin 12 is flexed into a convex shape.

Figure 9:
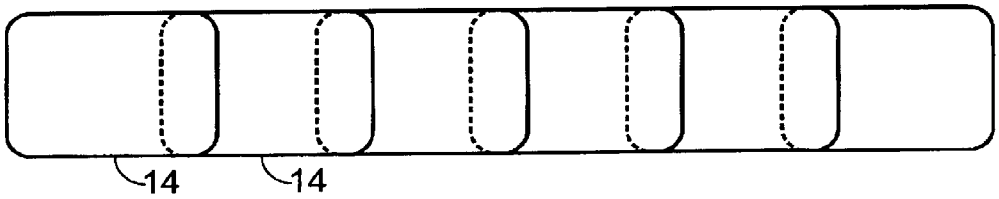
FIG. 9 is a plan view of the structure of FIG. 1.
Figure 10:
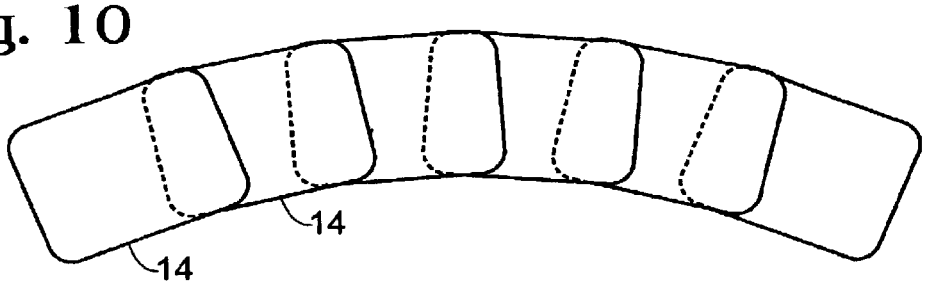
FIG. 10 is a plan view of the structure of FIG. 1 in a fan-shaped conformation.

FIGS. 9 and 10 are simplified diagrams showing a plan view of panels 14 adjusting to various conformational changes by skin 12. In FIG. 9, skin 12 is pulled taut. In FIG. 10, skin 12 is flexed in a fan-shape and the panels adjust accordingly, for example such that the degree of overlap differs along the width of a single panel. It should be appreciated that the above examples are to be considered non-limiting and that skin 12 may be flexed or moved in a wide variety of directions.

Structure 10 may further include a locking mechanism adapted to lock some or all of panels 14 into a specific position, temporarily and reversibly decreasing the flexibility and/or range of motion available to skin 12. As an example, each panel 14 may include an attachment device, which can be mated to one or more of a plurality of stabilizers. The stabilizers may be located on other panels 14 and/or on skin 12. For example, the locking mechanism may include a hook and loop fastener such as that sold under the trademark Velcro® by Velcro Industries B. V., a snap, a tie, a traditional hook and eye, or any other suitable device adapted to complete a mating engagement.

Figure 11:
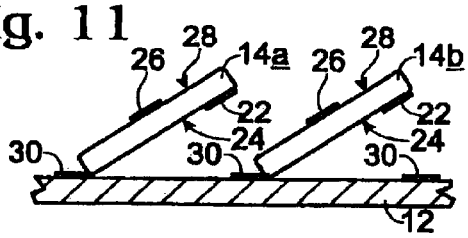
FIG. 11 is a side view of the structure of FIG. 1 including a locking mechanism.
Figure 12:
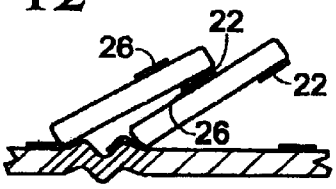
FIG. 12 is a side view of the structure of FIG. 11 locked in a compressed conformation.
Figure 13:
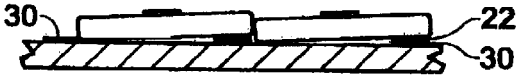
FIG. 13 is a side view of the structure of FIG. 111 locked in a taut conformation.

FIG. 11 depicts an exemplary structure 10 including a locking mechanism. As shown, a first panel 14*a* includes a strip 22 of Velcro® fastener on the underside 24 of the panel. A second panel 14*b* includes a matching strip 26 of Velcro® fastener on the topside 28 of the panel. Furthermore, skin 12 may include a strip 30 of Velcro® fastener. Panel 14*a* may be selectively fastened to either strip 26 or strip 30. When strip 22 is fastened to strip 26, skin 12 is forced to gather and the portion of structure 10 corresponding to panel 14*a* is locked into a compressed shape, as shown in FIG. 12. Alternatively, when strip 22 is fastened to strip 30, skin 12 is stretched taut and the portion of structure 10 corresponding to panel 14*a* is locked into a straightened shape, as shown in FIG. 13.

As will be appreciated, the component pieces of the locking mechanism may be placed so as to allow for structure 10 to be locked into any desired size, shape, or configuration, including the convex, concave, and fan-shaped configurations described above, or any combination thereof. For example, the entire upper surface of panel 14*b* and skin 12 could be covered with Velcro® fastener, allowing the user to adjust and fine-tune the placement of the panels to an infinite or near infinite degree.

Figure 14:
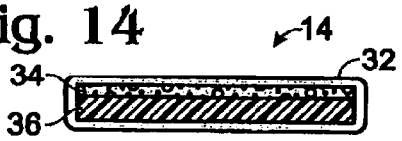
FIG. 14 is a cross-section of an exemplary panel suitable for use in the present invention.

FIG. 14 depicts an exemplary panel suitable for use with the present invention. As shown, panel 14 may include a casing 32 housing one or more layers of impact resistant and other material. For example, casing 32 may form an envelope adapted to receive the layered material. If panels 14 are attached to skin 12, as in the example described above, casing 32 may be attached to skin 12. Casing 32 may be formed of the same or a different material as skin 12. Typically, though not necessarily, casing 32 is formed of some type of durable fabric such as canvas, rip-stop nylon, and the like.

The material housed within casing 32 may include one or more impact absorbent layer made of foam, rubber, cotton batting, or some other impact absorbent material and/or one or more structural layer made of a rigid or semi-rigid material such as plastic, or metal. The panels shown in FIG. 14 include a single impact absorbent layer 34 and a single structural layer 36. As will be appreciated, panels 14 may include multiple layers of each type, additional layers of other materials, and/or a single layer of a material that provides both structural support and impact absorbance. The layers may be separable or joined together, as desired.

The plant structure may include a plurality of panels situated between dual layers of flexible skin. The dual layers may be joined together at appropriate intervals in order to form pockets suitable for receiving the panels. In some cases, these pockets may serve as casings in which impact absorbent and structural layers are housed.

Figure 15:
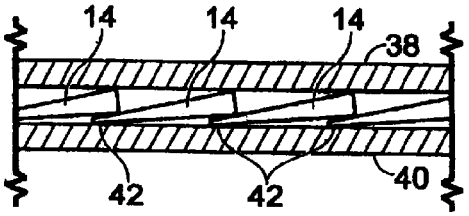
FIG. 15 is a cross-section of a dual-skinned structure according to another embodiment of the present invention.

FIG. 15 is a cross-section of an exemplary structure incorporating the dual layered skin, as described above. In this example, individual panels 14 are situated between a first layer 38 of flexible skin and a second layer 40 of flexible skin. Each panel is attached to the inner surface of first layer 38 by a living hinge 42. Thus, the first layer 38 of the flexible cover serves to anchor the panels, while the second layer 40 serves to maintain proper alignment of the panels as well as to give structure 10 a smooth outer appearance. As shown, the panels may be overlapped as previously described above.

In a preferred embodiment, the structure described above may be incorporated into conformable travel case 44. For the purposes of the present invention the term "travel case" is intended to include any type of bag or case intended to receive, carry and/or store contents including, but not limited to, bags, sacks, packs, pouches, suitcases, travel bags, overnight bags, garment bags, sports equipment bags, sports bags, handbags, purses, shoulder bags, tote bags, flight bags, knapsacks, rucksacks, backpacks, and duffle bags.

Figure 16:
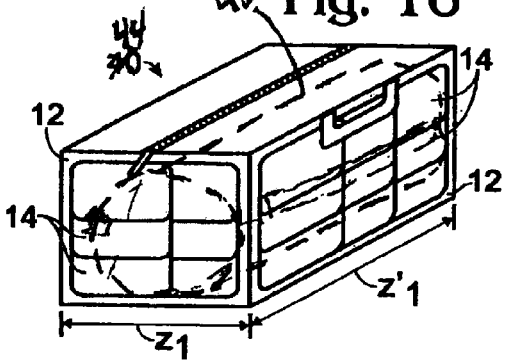
FIG. 16 depicts one embodiment of a travel case according to one embodiment of the present invention.
Figure 17:
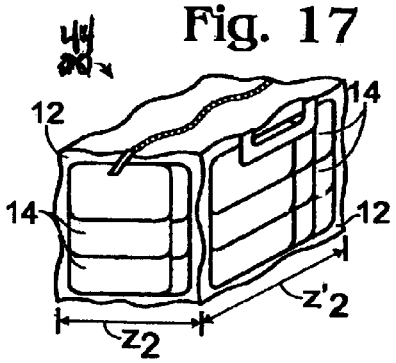
FIG. 17 depicts the travel case of FIG. 16 in a compressed configuration.

By incorporating the structure described above in one or more of the travel case walls, travel case 44 provides the protection of a hard or rigid travel case while further affording the lightweight flexibility of a soft travel bag. As shown in FIG. 16, the travel case 44 may be include one or more segments including multiple panels 14 positioned adjacent a flexible skin 12. As demonstrated in FIG. 17, the flexibility provided by the panels allows travel case 44 to compress when not in use or when carrying items that are smaller than the full capacity of the travel case.

Figure 18:
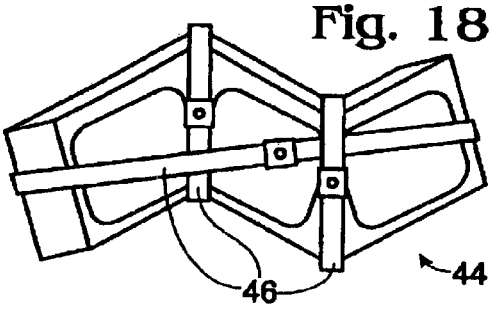
FIG. 18 depicts another travel case according to another embodiment of the present invention.

It should be appreciated that the travel case may also employ the locking mechanism described above, which may aid in adjusting the case to the size of the contents. Furthermore, the user may selectively employ the locking mechanism to some panels and not others in order to more precisely alter the shape and size of the case. Alternatively or additionally, as shown in FIG. 18, the travel case may include one or more straps 46 that allow the user to cinch the travel case around the contents within the case. Thus, the user may use the same travel case for both larger and smaller objects (such as different sized golf club sets). As will be appreciated, alternative methods of conforming the dimensions of the travel case to the contents may be used. For example, the travel case may include fasteners such as snaps or zippers independent of those used to lock the panels into place that allow the user to fold or bunch the travel case into a particular configuration.

It should also be appreciated that the structure described above need not be incorporated into the entire surface area of the travel case. Thus, one portion of the travel case may incorporate the protective structure, while another portion may be soft, hard, or incorporate different structure. As a non-limiting example, one side of a travel case may incorporate the protective structure described above, while the other side of the travel case may be made of soft, flexible material.

In some embodiments, travel case 44 may be formed generally in the shape of the intended contents. For example, if the travel case is intended to transport a golf bag, the flexible skin may form an elongated cube or cylinder. As will be appreciated, other shapes and sizes may be formed, as desired.

As Will be appreciated, travel case 44 may include any of the features commonly found on other travel cases including one or more carrying strap, zipper, and/or pockets, dividers, wheels, and the like.

While the present invention has been particularly shown and described with reference to the foregoing preferred embodiments, those skilled in the art will understand that many variations may be made therein without departing from the spirit and scope of the invention. The description of the invention should be understood to include all novel and non-obvious combinations of elements described herein, and claims may be presented in a later related application to any novel and non-obvious combination of these elements. Where the disclosure recites "a" or "a first" element or the equivalent thereof, such disclosure should be understood to include incorporation of one or more such elements, neither requiring nor excluding two or more such elements.

What is claimed is:

1. A travel case comprising:

a protective outer enclosure, at least a portion of which includes, a flexible skin, and a plurality of substantially rigid impact resistant panels positioned adjacent the flexible skin, the plurality of panels being adapted to conform to the shape of the flexible skin as it is flexed; wherein the protective outer enclosure is configured to flex from a first configuration to a second configuration, and at least two of the panels are configured to increasingly overlap as the protective outer enclosure is laterally compressed; and wherein each of the panels is polygonal, and hinged to the skin along a panel edge.

2. The travel case of claim 1, wherein the protective outer enclosure is configured to be laterally expanded.

3. The travel case of claim 2, including panels configured to decreasingly overlap as the protective outer enclosure is expanded.

4. The travel case of claim 2, including panels configured to abut when protective outer enclosure is fully expanded.

5. The travel case of claim 1 wherein the travel case is adapted to receive a golf bag.

6. The travel case of claim 1 wherein at least one of the impact resistant panels includes a malleable material.

7. The travel case of claim 6, wherein the malleable material is selected from the group consisting of foam, cotton batting, and rubber.

8. A travel case comprising:

a protective outer enclosure, at least a portion of which includes, a flexible skin, and a plurality of substantially rigid impact resistant polygonal panels coupled to the flexible skin along a panel edge by a hinge, the plurality of panels being adapted to conform to the shape of the flexible skin as it is flexed wherein the protective outer enclosure is configured to flex from a first configuration to a second configuration, thereby altering the footprint of the overlapped panels; and wherein the panels are configured to increasingly overlap as protective outer enclosure is laterally compressed.

9. The travel case of claim 8 wherein the travel case is adapted to receive a golf bag.

10. The travel case of claim 8 wherein at least one of the impact resistant panels includes a malleable material.

11. The travel case of claim 10, wherein the malleable material is selected from the group consisting of foam, cotton batting, and rubber.

12. A travel case comprising:

a protective outer enclosure, at least a portion of which includes, a flexible skin, and a plurality of substantially rigid impact resistant panels positioned adjacent the flexible skin, the plurality of panels being adapted to conform to the shape of the flexible skin as it is flexed; wherein the protective outer enclosure is configured to flex from a first configuration to a second configuration, and at least two of the panels are configured to increasingly overlap as the protective outer enclosure is laterally compressed, wherein the flexible skin is an outer skin and the plurality of panels are mounted inward of the outer skin, the enclosure further including a flexible inner skin positioned inwardly adjacent the plurality of panels.

13. The travel case of claim 12, wherein the inner and outer flexible skins form a housing that limits the range of motion of the panels.

14. A travel case comprising:

a protective outer enclosure, at least a portion of which includes, a flexible skin, and a plurality of substantially rigid impact resistant panels positioned adjacent the flexible skin, the plurality of panels being adapted to conform to the shape of the flexible skin as it is flexed; wherein the protective outer enclosure is configured to flex from a first configuration to a second configuration, and at least two of the panels are configured to increasingly overlap as the protective outer enclosure is laterally compressed;

the travel case further including a locking mechanism adapted to temporarily and reversibly lock at least one of the panels into a first orientation.

* * * * *